United States Patent [19]

van Lierop

[11] 4,405,194

[45] Sep. 20, 1983

[54] ELECTRICAL PLUG

[75] Inventor: Dirk F. W. van Lierop, Eindhoven, Netherlands

[73] Assignee: U.S. Philips Corporation, New York, N.Y.

[21] Appl. No.: 310,669

[22] Filed: Oct. 13, 1981

[30] Foreign Application Priority Data

Nov. 28, 1980 [NL] Netherlands ..... 8006481

[51] Int. Cl.[3] ..... H01R 3/00

[52] U.S. Cl. ..... 339/147 P; 339/196 M; 339/218 M

[58] Field of Search ..... 339/147 R, 147 P, 195 R, 339/195 A, 195 M, 196 R, 196 A, 196 M, 218 R, 218 M

[56] References Cited

U.S. PATENT DOCUMENTS 2,528,971 11/1950 Philips ..... 339/196 A X 3,829,819 8/1974 Eckart ..... 339/147 P X

FOREIGN PATENT DOCUMENTS 2367359 5/1978 France .

OTHER PUBLICATIONS

Design Engineering, *Integral Moulded Plug Improves Appliance Safety,* 11-1978, p. 27.

*Primary Examiner*—Mark Rosenbaum

*Attorney, Agent, or Firm*—Robert J. Kraus

[57] ABSTRACT

An electrical plug including a base having a rear portion with terminals, a front portion in which a recess is formed for receiving a fuse, and having openings extending from the recess to the rear portion. An insulating cap, including pins for extending into and closing the openings, is attached to the rear portion of the base to cover the terminals before forming an injection molded plug body of plastic material around the rear portion. If the insulating cap is inadvertently omitted the plastic material flows into the recess, preventing insertion of a fuse, thus protecting against use of a defective plug.

2 Claims, 3 Drawing Figures

ELECTRICAL PLUG

BACKGROUND OF THE INVENTION

The invention relates to an electrical plug, comprising a base with connection pins which project from the front thereof and which are connected to conductors of a connection cable by means of terminals on the rear of the base. An insulating cap attached to the rear of the base covers at least one of the terminals and comprises at least one integral pin which projects into an opening extending from the rear to the front of the base. The front of the base includes a recess for a fuse and contacts for the fuse. The rear of the base and the entire insulating cap are enclosed by an injection molded plastic plug body.

A plug of this kind is known from French Patent Specification No. 2,367,359 laid open to public inspection. The insulating cap serves to ensure that no loose wires of the connection cable can project from the plug body, as this would be very dangerous. The integral pin of the insulating cap closes the opening in the base and its end will be visible at the front of the plug after the injection molding of the plug body. It can thus be checked afterwards whether the insulating cap is indeed present in the plug. If this is not the case, the plug should be rejected, but if a plug without insulating cap is accidentally accepted, it will be unsafe in use.

SUMMARY OF THE INVENTION

It is an object of the invention to provide a plug of the kind set forth which does not function if the insulating cap is absent, so that the plug cannot be accidentally used. In accordance with the invention the opening for the pin opens into the recess and is closed by the pin after attachment of the insulating cap, so that no plastic can flow into the recess during the injection molding process. If the insulating cap is absent, plastic will flow into the recess during the injection moulding process by way of the opening for the pin and it will be impossible to insert a fuse.

BRIEF DESCRIPTION OF THE DRAWING

The invention will be described in detail hereinafter with reference to the drawing. Wherein.

DESCRIPTION OF THE PREFERRED EMBODIMENT

Figure 1:
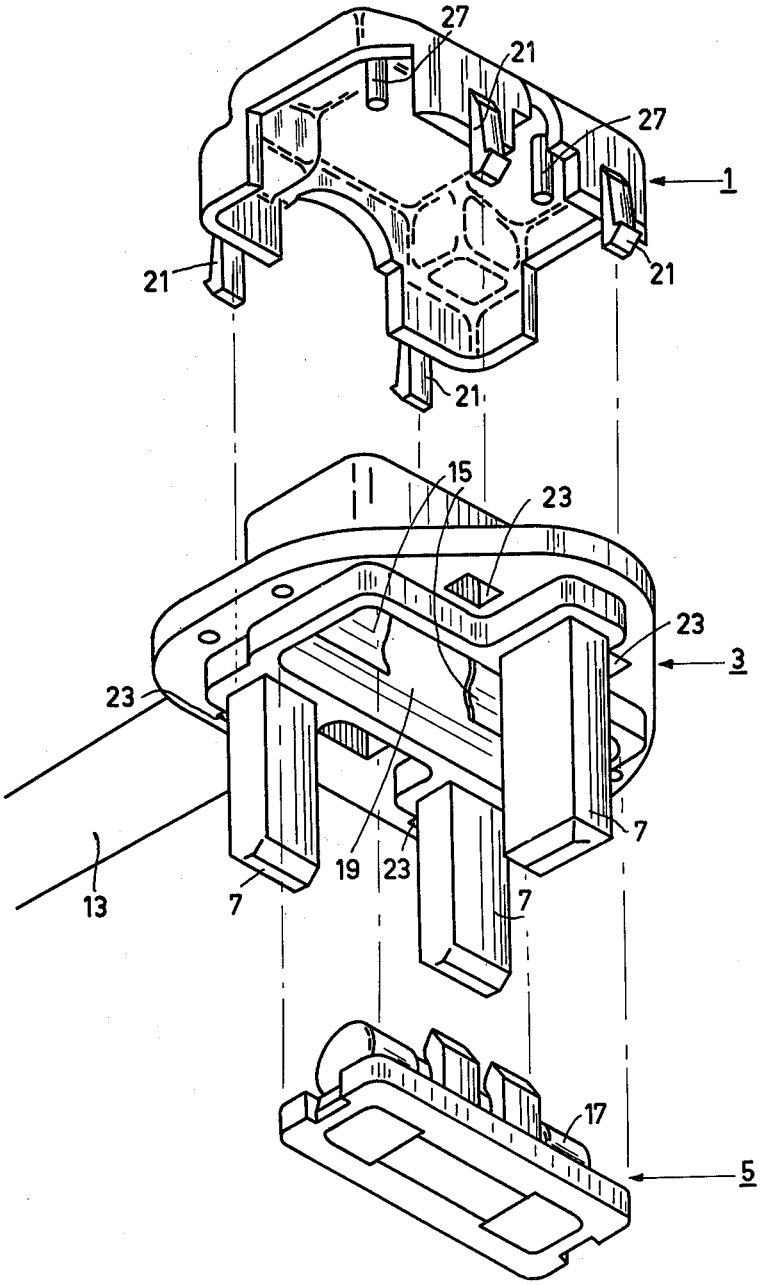
FIG. 1 is a perspective view of parts of a plug prior to assembly.
Figure 2:
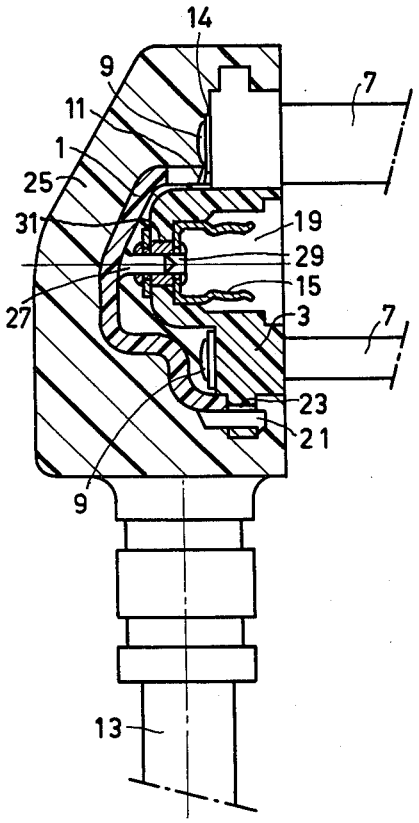
FIG. 2 is a longitudinal sectional view of an assembled plug including a plug body.

FIG. 1 shows, from top to bottom, an insulating cap 1, a base 3, and a fuse holder 5. The front of the base 3 (the lower side in FIG. 1) comprises three rectangular connection pins 7 which are connected to terminals 9 on the rear of the base (see FIG. 2). Each terminal is connected to a conductor 11 of a connection cable 13 when the plug is fitted. To this end, at the end of each conductor 11 there is formed a lug 14 which is riveted to the terminal 9. Only one of the three conductors 11 is visible in FIG. 2. Connection of two of the three pins to their associated conductors is accomplished by means of two clamping contacts 15 which are interconnected by means of a fuse 17. The fuse is accommodated in the fuse holder 5 which fits in a recess 19 in the base 3 and containing the clamping contacts 15. The extreme right connection pin 7 in the base shown in FIG. 1 is constructed as a ground contact, and the other two connection pins 7 serve to contact the neutral connection and phase connection of a wall receptacle (not shown). For example, the extreme left pin 7 is connected to a conductor of the connection cable 13 via the clamping contacts 15.

The insulating cap 1 comprises resilient hooks 21 which project through openings 23 in the base when the insulating cap is attached to the rear of the base 3, thus ensuring a firm and simple connection of the insulating cap to the base in known manner. After attachment to the base 3, the insulating cap 1 covers the terminals 9 of both connection pins 7 which do not act as a ground contact, as is clearly shown in FIG. 2. Should one of the wires of the conductor 11 fail to be connected to the terminal 9 when the conductor is connected to the terminal, this wire will remain within the space bounded by the insulating cap 1 and the base 3 after attachment of the insulating cap.

After attachment of the insulating cap 1, the rear of the base and the entire insulating cap and its contents are covered by a plastic plug body 25 in a formed mold by injection molding. Any loose wires of the conductors 11 which are located within the insulating cap 1 then remain remote from the outer circumference of the plug body 25, so that there is no danger of these wires being touched during use of the plug. This safety step is superfluous for the terminal 9 connected to the ground contact, because touching of this point is not dangerous. However, if desirable, the insulating cap 9 can be shaped so that it also covers this terminal.

The insulating cap 1 comprises two integral pins 27 which project into openings 29 after attachment of the insulating cap to the base 3. The openings 29 extend between the front and the rear of the base. These openings are disposed so that they open into the recess 19 at the front of the base 3. If the insulating cap 1 has not been fitted before the injection molding of the plug body 25, the openings 29 will be open so that plastic will flow into the recess 19 during the injection molding process. As a result, it will be impossible to fit the fuse 17 in the recess, so that one of the connection pins 7 will not contact the associated conductor 11 and the plug cannot function. When the insulating cap 1 has been fitted, the pins 27 close the openings 29 so that the recess 19 will not be filled.

In order to simplify the construction, the openings 29 are preferably formed by fixing bushings 31 which also serve to secure the clamping contacts 15 in the base 3. If desirable, it would also be possible for the insulating cap 1 to comprise only one pin 27 which projects through one of the fixing bushings or through another opening especially provided in the fuse chamber 19 for this purpose. In that case the fixing bushings not cooperating with a pin 27, obviously, must be closed in another manner or be replaced by fixing means without through-openings.

Figure 3:
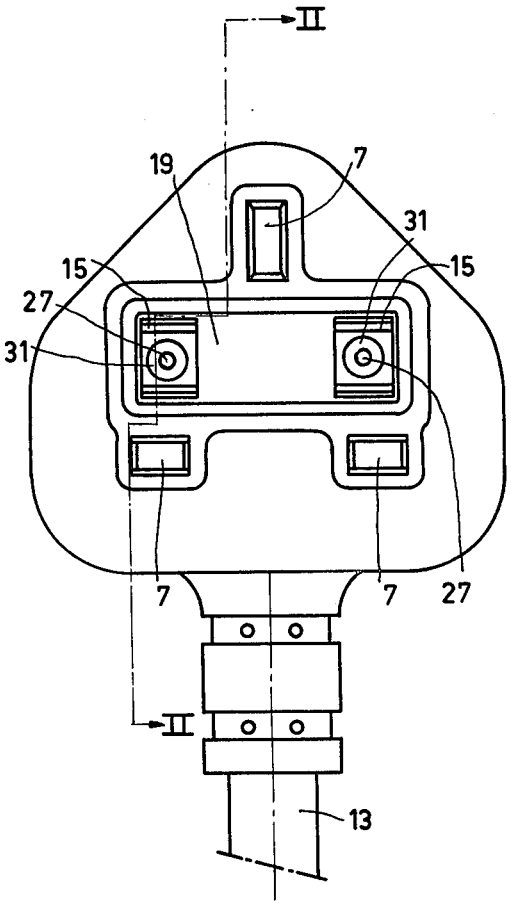
FIG. 3 is a front view of the plug shown in FIG. 2.

In order to make the presence of the insulating cap 1 readily ascertainable, it preferably has a colour which differs from that of the front of the base 1, so that the ends of the pins 27 will be conspicuous when the front of the plug is observed after removal of the fuse holder 5 (see FIG. 3).

What is claimed is:

1. An electrical plug comprising:

(a) a base including a front and a rear portion and having an opening extending from the front portion to the rear portion, said front portion having connection pins projecting therefrom and having a recess in which are disposed contacts for electrical connection to a fuse, and said rear portion having terminals electrically-connected to respective ones of the connection pins;

(b) a connection cable including wires electrically connected to respective ones of the terminals;

(c) an insulating cap for attachment to the rear portion of the base to cover at least one of the terminals, said insulating cap including a pin for projecting into the opening when the cap is attached to the base; and (d) an injection molded plug body of plastic material for covering the rear portion of the base and the insulating cap;

said opening communicating with the recess, and said cap's pin serving as means to prevent the plastic material from flowing into the recess if the insulating cap is attached when the plug body is injection molded.

2. An electrical plug as in claim 1 where the base includes two of said openings and where the insulating cap includes two of said pins for projecting into the openings, said openings being formed by two bushings extending through the base, said bushings also serving as means for securing the contacts disposed in the recess.

* * * * *